United States Patent [19]

Morris et al.

[11] 4,141,159

[45] Feb. 27, 1979

[54] METHOD AND APPARATUS FOR DEEP SEA MINING

[75] Inventors: Wilford V. Morris, Houston, Tex.; George W. Sheary, III, Redmond, Wash.

[73] Assignee: Summa Corporation, Las Vegas, Nev.

[21] Appl. No.: 779,236

[22] Filed: Mar. 18, 1977

[51] Int. Cl.[2] ..... E02F 3/88; E02F 7/02; E02F 7/10

[52] U.S. Cl. ..... 37/58; 37/195; 37/DIG. 8; 60/398

[58] Field of Search ..... 37/DIG. 8, 58, 55, 61-63, 37/59, 195; 299/8, 9; 302/14, 15, 57; 60/398, 369; 91/282

[56] References Cited

U.S. PATENT DOCUMENTS

| | | | |
|---|---|---|---|
| 2,672,700 | 3/1954 | Hanks, Jr. | 37/55 |
| 3,433,531 | 3/1969 | Koot et al. | 37/DIG. 8 |
| 3,672,725 | 6/1972 | Johnson | 37/DIG. 8 |
| 3,693,272 | 9/1972 | Gariel | 37/63 |
| 3,753,303 | 8/1973 | Holzenberger et al. | 37/DIG. 8 |
| 3,815,267 | 6/1974 | Laarman | 37/DIG. 8 |
| 3,909,960 | 10/1975 | Casciano | 302/15 X |
| 4,053,181 | 10/1977 | Saito | 37/DIG. 8 |

FOREIGN PATENT DOCUMENTS

| | | | |
|---|---|---|---|
| 1156547 | 6/1969 | United Kingdom | 37/55 |
| 420806 | 8/1974 | U.S.S.R. | 60/369 |

*Primary Examiner*—Clifford D. Crowder
*Attorney, Agent, or Firm*—Robert A. Felsman

[57] ABSTRACT

Mineral aggregates or nodules dispersed on the floor of an ocean are harvested and conveyed to a surface vessel, which tows a submerged harvesting apparatus. This apparatus is suspended from the vessel by a string of dual concentric pipes, which contains pressurized water for hydraulically conveying the aggregates to the surface. Pumps on the surface vessel force water down an annular passage between inner and outer pipes of the string. A portion of the downward flow is distributed to a feeder mechanism which collects crushed aggregates and feeds them into the return fluid flowing up the inner pipe. An inclined channel collects the aggregates from the underwater floor with water jets which dislodge and push the aggregates up the channel, where they are crushed by rollers. A portion of the downward flow of water from the surface is converted to lower pressure and higher volume downhole by using a dual piston converter to supply water to the water jets. Crushed aggregates are temporarily stored underwater in a bin, which feeds the crushed aggregates by gravity into the water stream for conveyance to the surface.

15 Claims, 10 Drawing Figures

Fig.9
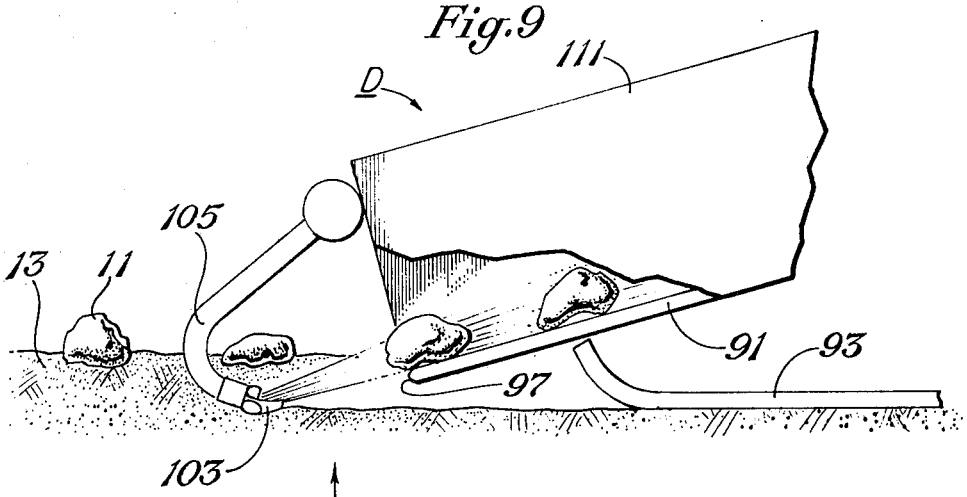
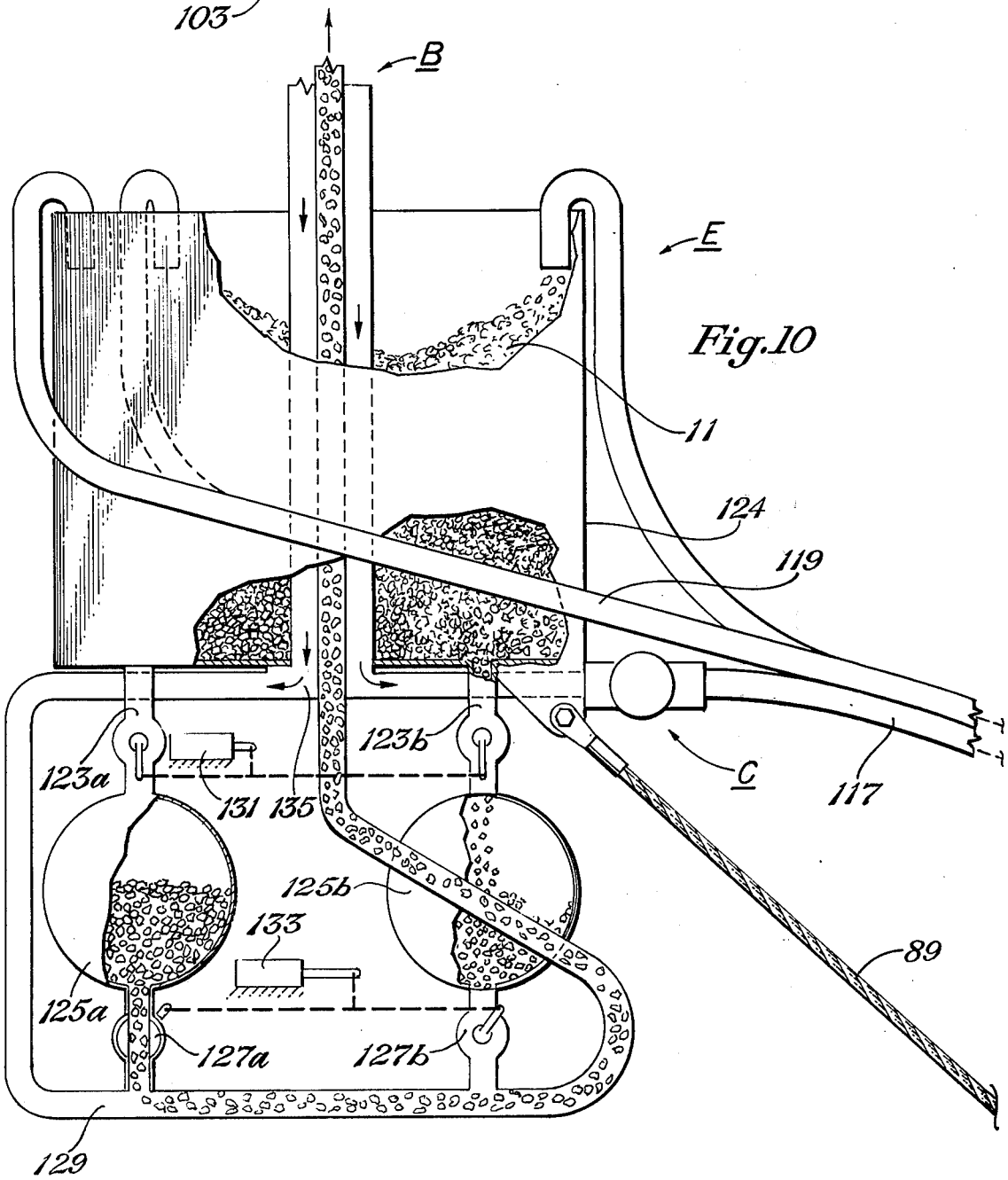
Fig.10

METHOD AND APPARATUS FOR DEEP SEA MINING

BACKGROUND OF THE INVENTION

1. Field of the Invention

This invention relates in general to the mining of minerals from underwater and in particular to the harvesting of mineral nodules located on the floor of an ocean.

2. 1 Description of the Prior Art

Ferromanganese nodules or aggregates are known to exist in large quantities on ocean floors, frequently at depths varying from 5,000 to 19,000 feet. Previously, means have been suggested for scraping or picking up the loose aggregates from the sea floor and transmitting them to the surface. U.S. Pat. No. 3,588,174 discloses a collector that is towed across the undersea floor, dislodging the aggregates partially by water spray, the aggregates being pumped to the surface in a stream of water within a conduit. U.S. Pat. No. 3,802,740 and Canadian Pat. No. 692,998 disclose devices that also collect aggregates from an undersea floor and transmit them in a conduit to the surface. Such devices convey the collected aggregate to the surface by utilizing submerged pumps. A submerged pump usually requires a protective capsule and may be difficult to service, especially at great depths.

It is known to use dual concentric pipes for well drilling, as shown in U.S. Pat. No. 1,461,240, where water is pumped down the annulus, then returned up the inner pipe to create a suction to draw loose material from the floor. This eduction system cannot be used with the high hydrostatic pressure that occurs at depths of 5,000 to 19,000 feet. Dual concentric pipes are also known in well drilling using gas as a circulation medium, as in U.S. Pat. No. 3,065,807.

SUMMARY OF THE INVENTION

The invention may be summarized as an underwater harvester of mineral nodules or aggregates that uses a dual concentric string of pipe extending from a surface vessel to a submerged gathering apparatus for supplying water and power to the gathering apparatus and for conveying the aggregate to the surface. Water is pumped down an annular passage in the dual string and through a conduit loop leading to an inner pipe. Crushed and collected aggregates are dropped by gravity into the conduit loop for conveyance to the surface. The aggregates are gathered from the underwater floor by being dislodged and forced onto an inclined channel using water jet nozzles. Roller crushers located at the end of the channels crush the aggregates. The crushed aggregates are conveyed to a temporary storage bin located near the gathering apparatus. The aggregates are released from the bin to fall into feeder chambers, the feeder chambers alternately allowing the aggregates to drop into the conduit loop leading to the inner pipe. A portion of the high pressure stream from the annulus is converted to a lower pressure by dual co-acting reciprocating pistons for supplying water to the nozzles.

BRIEF DESCRIPTION OF THE DRAWING

FIG. 9 is an enlarged fragmentary side elevational view, partially broken away, of the gathering apparatus of FIG. 8.

FIG. 10 is a storage bin and feeder mechanism used in conjunction with the mining apparatus of FIG. 1.

DESCRIPTION OF THE PREFERRED EMBODIMENT

Figure 1:
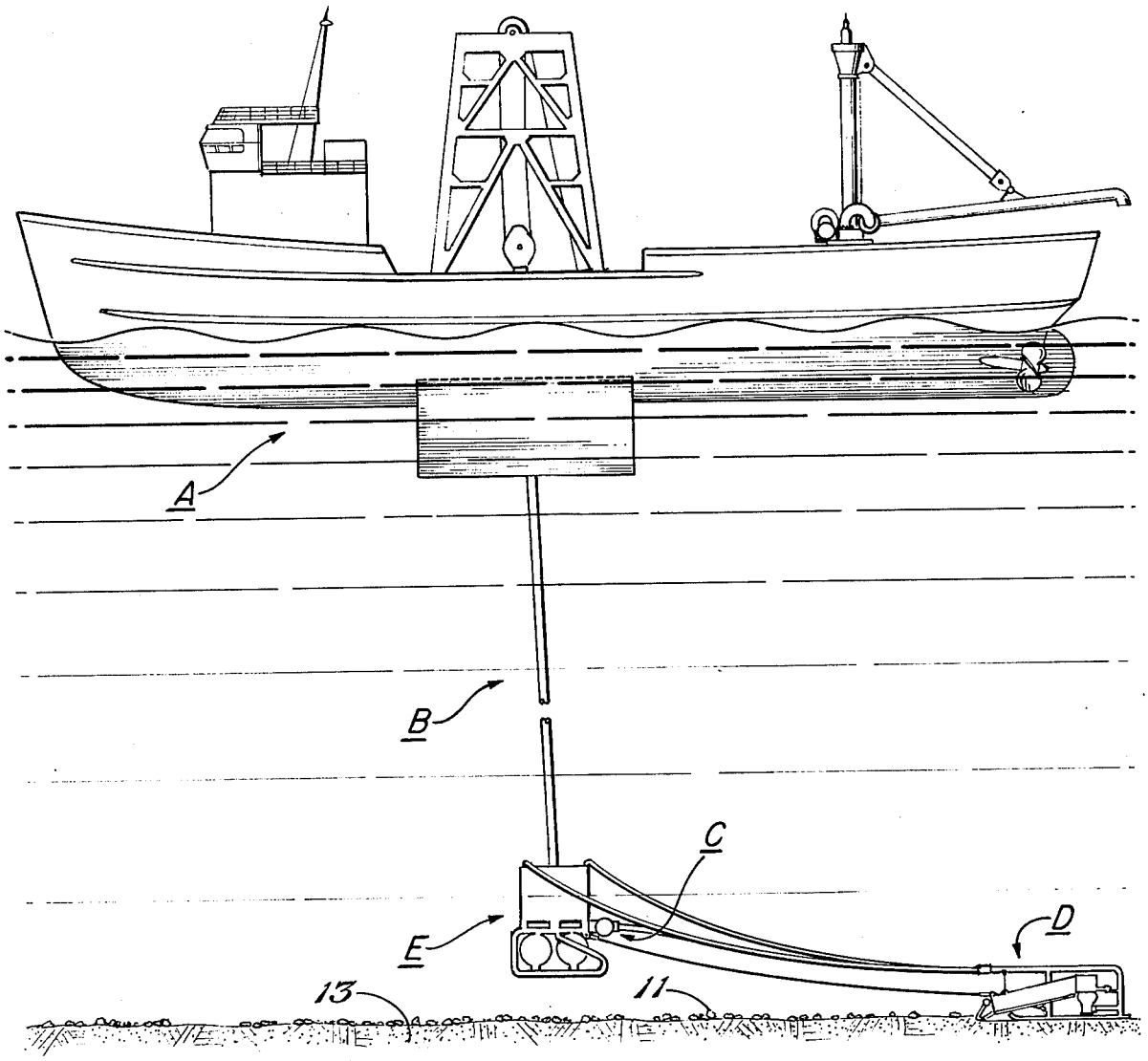
FIG. 1 is a schematic view of apparatus constructed in accordance with the teachings of this invention.

FIG. 1 illustrates schematically the mining apparatus for mining mineral aggregates or nodules 11 from an undersea floor 13, including a surface vessel A for towing the undersea equipment. A string of dual concentric pipes B, connected from the surface vessel A to the undersea equipment, serves as a tow line and as a conduit for water pumped from the surface vessel to the undersea equipment and back to the surface along with crushed nodules. A pressure converter C converts the high pressure stream of water being pumped by the pumps on the surface vessel to a lower pressure higher volume for use with the gathering apparatus D. The gathering apparatus D collects and crushes the nodules 11 and conveys them to a temporary storage bin and feeder mechanism E. Storage bin and feeder mechanism E, suspended at the end of the dual string approximately 50 feet above the undersea floor surface 13, tows the gathering apparatus D approximately 200 feet behind it. The bin and feeder mechanism E temporarily stores the crushed nodules 11, and gravity feeds them into the dual pipe B for transmission to the surface. The pressure converter C, gathering apparatus D, and storage bin and feeder mechanism E serve as harvesting apparatus or means for collecting and transmitting the aggregates to the surface vessel.

DUAL PIPE

Figure 2:
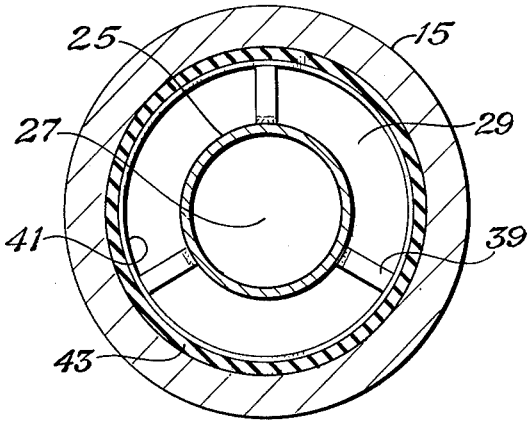
FIG. 2 is a cross sectional view of the dual pipe for use with the mining equipment of FIG. 1, as seen looking along the lines II—II of FIG. 4.
Figure 3:
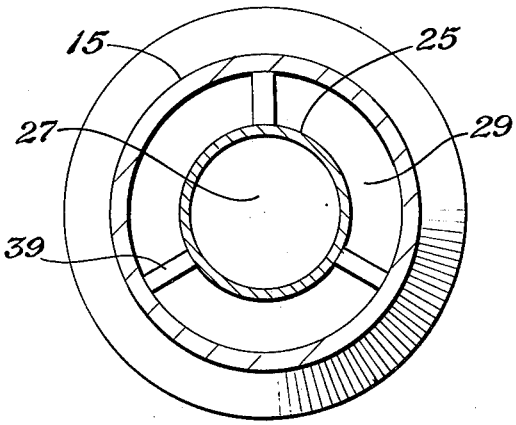
FIG. 3 is a cross sectional view of the dual pipe shown in FIG. 4 as seen looking along the lines III—III.
Figure 4:
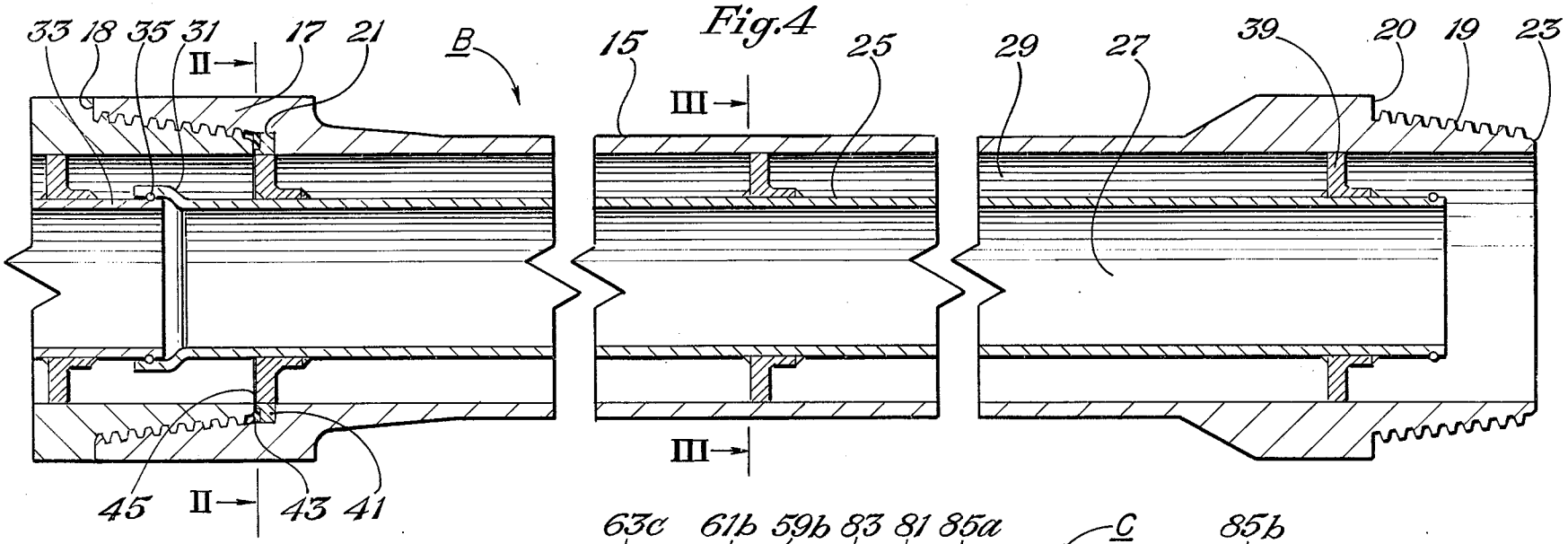
FIG. 4 is a vertical cross sectional view of a dual pipe used in conjunction with the mining equipment shown in FIG. 1.

The dual pipe string B is shown in FIGS. 2, 3, and 4. Referring to FIG. 4, wherein the upper end of the pipe is on the left side of the drawing, an outer pipe 15 is made up of a plurality of sections or stands, each 30 or more feet long. Each stand contains an externally upset threaded box section 17 on its upper end and an externally upset threaded pin section 19 on its lower end, defining a joint for screwing the stands together. The box section 17 and pin section 19 each have external shoulders 18, 20, respectively, to limit the make-up position. The box section 17 has an internal shoulder 21 that is spaced a selected distance below the end 23 of the threaded pin 19 when fully made up.

An inner pipe 25 is carried concentrically within the outer pipe 15, and is made up of a plurality of sections or stands to form a continuously open inner passage 27 and an annular passage 29 between the walls of the inner pipe 25 and outer pipe 15. The upper end of each stand of inner pipe 25 has an enlarged portion 31 for receiving the lower end 33 of the upper stand, defining a joint for connecting the inner pipe stands together. The lower ends 33 are cylindrical and fit telescopingly within the enlarged portion 31. A seal 35, between the inner end 33 and enlarged portion 31, prevents leakage.

Each stand of inner pipe 25 has a plurality of centralizers or spokes 39 attached to the inner pipe 25 and closely received within the outer pipe to maintain the pipes in concentric relation to each other. As shown in FIGS. 2 and 3, each set of spokes 39 is a group of three radial projections spaced apart 120° for allowing water to pass through the annular passage 29. One set of spokes 39 is located near the lower end of the inner pipe stand 25 and another near the middle. The upper set of spokes 39, located near the enlarged portion 31 has a rigid metal ring 41 attached to the periphery of the spokes 39 for carrying the inner pipe 25 within the outer pipe 15. Ring 41 is larger than the inner diameter of the outer pipe 15 and rests on internal shoulder 21 of the outer pipe 15. A resilient ring seal 43 is seated within a shoulder on the upper side and outer portion of ring 41. The inner width or seal 43 extends from the outer periphery of ring 41 inward to a point slightly short of the inner wall of the outer pipe 15, so that while deformed no part of the seal will be extended into the annular passage where a high flow rate of water occurs. Seal 43 is thicker than its shoulder within which it seats, so that the seal is deformed by the end 23 of the threaded pin 19 when the outer pipe stands are fully made up. The distance between the internal shoulder 21 and end 23 of threaded pin 19 when the outer stands are fully made up is slightly larger than the width of the metal ring 41 so that a clearance 45 exists when the outer pipes 15 are fully made up. Seal 43 minimizes leakage into the threads from the annular passage 29. It is expected that the string of dual pipes B would not be pulled very often, thus frequent inspection or cleaning of threads would not be possible, resulting in corroded threads if a seal was not present.

A suitable inner pipe 25 is 10¾ inch outer diameter, J-55, 44 pounds per foot A.P.I. (American Petroleum Institute) casing with 0.400 inch wall thickness. A suitable outer pipe 15 is 20 inch outer diameter, X-135 grade, 104 pounds per foot A.P.I. casing or line pipe with ½ inch wall. The pipes may be lowered into the sea by screwing the outer stands 15 together, while the inner pipes 25 simultaneously telescope and seal within each other. When pulling the string, the inner pipes may be removed for cleaning, inspection, or may be racked and stored within the outer pipes.

PRESSURE CONVERTER

A portion of the water pumped down the annular passage 29 will be returned along with crushed nodules 11 up the inner passage 27, while another portion will be used to collect and crush the nodules. The flow pressure at the bottom of the drill string should be relatively high, for example 2000 psi., while only 200 psi. is required for collecting and crushing. This pressure is converted by pressure converter C as shown in FIGS. 5, 6 and 7.

Figure 7:
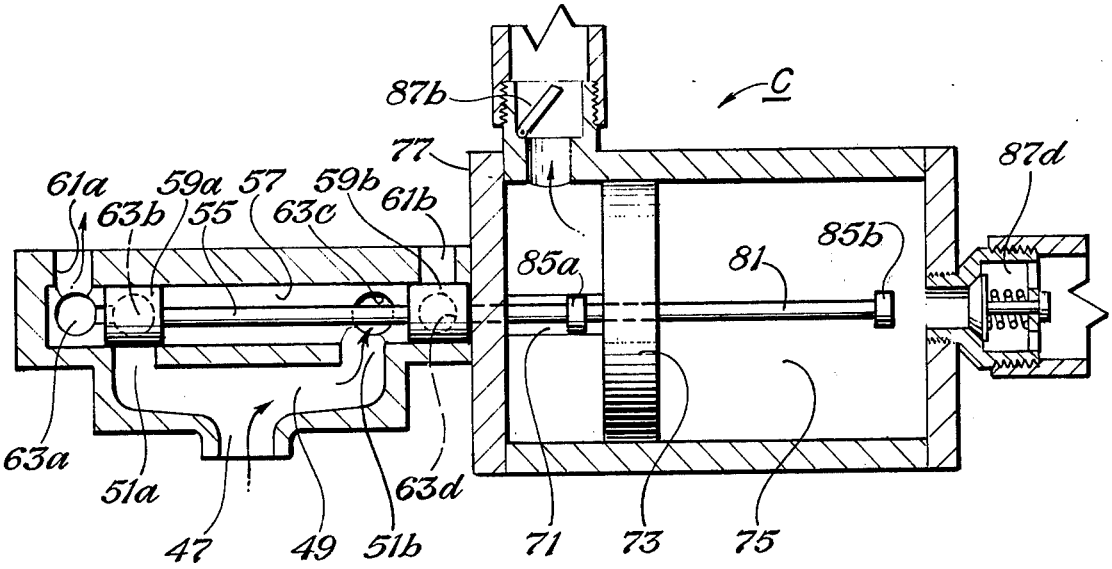
FIG. 7 is a partial cross sectional view of the pressure converter of FIG. 5 as seen from the top as shown in the drawing.

Referring to FIG. 7, a high pressure inlet 47 leads to a manifold 49 that has two inlet ports 51*a, b* spaced apart from each other. A sliding valve 55 is located in a cylindrical valve chamber 57 adjacent the inlet ports 51*a, b*. The valve 55 has two cylindrical plugs 59*a, b* closely received in the valve chamber 57 and of width at least equal to inlet ports 51*a, b* so that they may be closed by the plugs 59*a, b*. The plugs 59 *a, b* are spaced apart on a shaft so that when one port 51 is covered, the other port is fully opened. Two exhaust ports 61*a, b* are located on the opposite sides of ports 51*a, b*, and are of a size sufficient to be closed by plugs 59*a, b*. The exhaust ports 61*a, b* may lead to the surrounding sea, or be used for other high pressure uses. The exhaust ports 61*a, b* are spaced so that when one is closed by plug 59, the other exhaust port is open. The exhaust ports 61*a, b* are spaced one port width wider on each end than the inlet ports 51*a, b* so that when an exhaust port is open on one side, the corresponding inlet port on that side will be closed.

Four ports 63*a, b, c, d* are located on the lower surface of the cylindrical valve chamber as shown on the drawing, two ports being adjacent each end of the valve stroke. Ports 63 are of a size to be closed by the plugs 59 and are spaced so that when one port 63 on each end is closed, the other port on the same end is open. Also on each end, one port 63 is aligned with an exhaust port 61 and one port 63 with an inlet port 51, so that they may be closed simultaneously by the valve plugs 59. In the position as shown in FIG. 7, inlet port 51*a* is closed along with port 63*b*, while port 63*a* and exhaust port 61*a* are open. Intake port 51*b* is open along with port 63*c*, while exhaust port 61*b* and port 63*d* are closed. Valve 55 may be reciprocated within the valve chamber 57 to reverse the opening and closing of ports.

Figure 5:
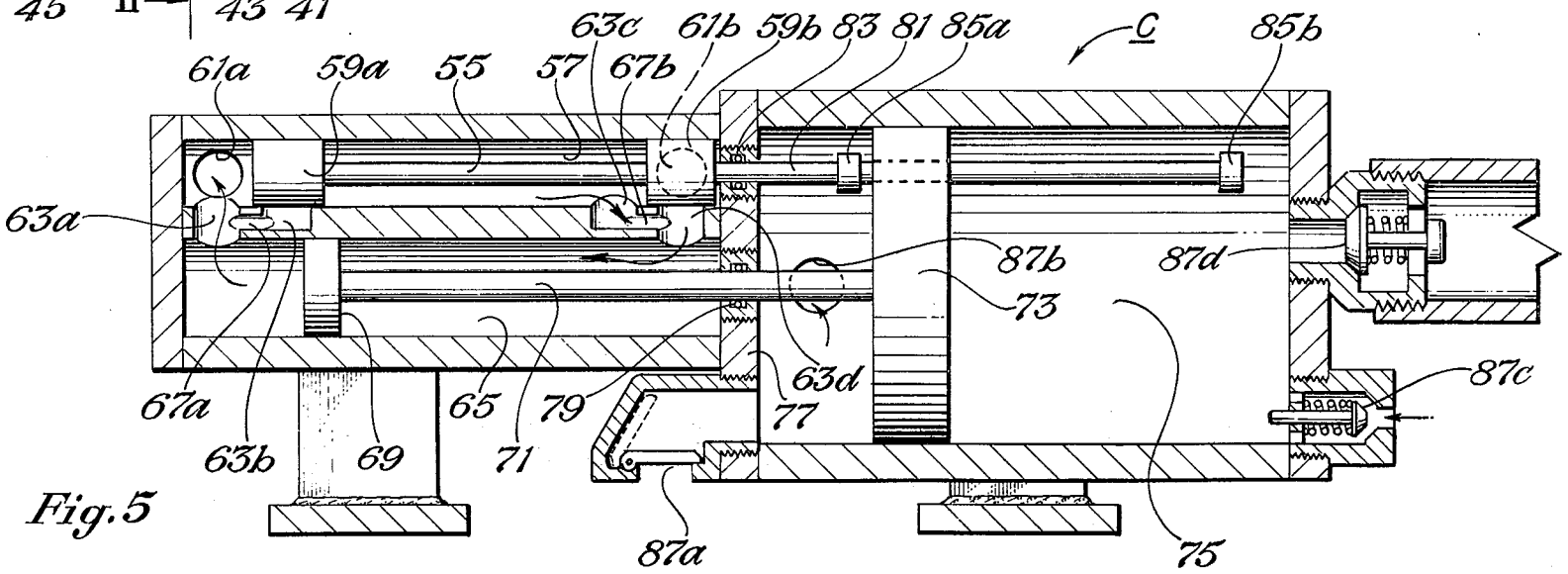
FIG. 5 is a partial cross sectional view of a pressure converter used in conjunction with the mining equipment of FIG. 1.
Figure 6:
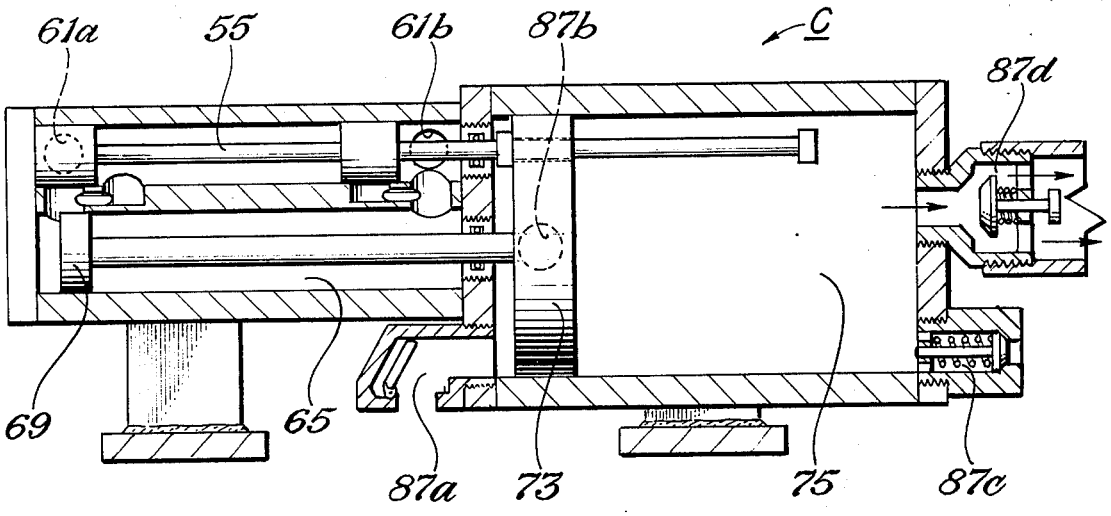
FIG. 6 is a partial cross sectional view of the pressure converter of FIG. 5 with its sliding valve shown in a different position.

Referring to FIG. 5, ports 63*a, d* lead directly to a high pressure chamber 65. Port 63*b, c* are connected by internal passages 67*a, b* to ports 63*a, d*, thus also lead to high pressure cylindrical chamber 65. A high pressure piston 69 is reciprocally carried in the high pressure cylinder 65 and is connected by a shaft 71 to a substantially larger piston 73 in an adjacent low pressure cylindrical chamber 75. High pressure chamber 65 is separated from low pressure chamber 75 by a wall 77 through which the shaft 71 slidably passes. A seal 79 within wall 77 prevents leakage from the high pressure chamber 65 to the low pressure chamber 75.

Wall 77 also provides separation between the valve chamber 57 and the low pressure chamber 75. A shaft 81 slidably passes through wall 77 and also through low pressure piston 73. A seal 83 within wall 77 prevents leakage from the valve chamber 57 to the low pressure cylinder 75. Enlarged portions 85*a, b*, provided on shaft 81, are larger than the aperture in low pressure piston 73 within which the shaft 81 loosely passes. The enlarged portions 85*a, b* are spaced apart a selected distance so as to be contacted by the low pressure piston 73 near each end of its stroke to shift the valve 55 to the opposite position.

Four one-way valves 87*a, b, c, d*, two opposite each end, are located in the low pressure chamber 75. On each end, the one-way valves are opposed so that when the piston 73 is moving toward them, the inward opening valve, or intake valve, will be closed and the outward opening valve will be open. The intake valves allow water to enter from the surrounding sea when open. The outlet valves are connected to the gathering apparatus D. Valves 87*c, d* are open as poppet-type, while valves 87*a, b* are shown as hinged-type. These types may be interchanged and other valves used as well.

In operation, high pressure water pumped through the annular passage 29 will pass to inlet 47 of the manifold 49. If the pressure converter C is in the position as shown in FIGS. 5 and 7, the high pressure water will flow into the valve chamber 57 via inlet port 51*b* as shown by the arrows. This high pressure water flows then through port 63*c*, since port 63*b* is closed by plug 59*a*, and since access to exhaust port 61*b* is blocked by plug 59*b*. Referring to FIG. 5, the high pressure water then flows, as indicated by the arrows, down into the right hand side of the high pressure cylinder 65. This forces the high pressure piston 69 to the left, drawing with it the low pressure piston 73. Water within chamber 75 on the left of low pressure piston 73 will be forced out the outlet port 87*b*, the intake port 87*a* remaining closed since it operates only one way. This water flow then passes to the gathering apparatus D. The exhaust fluid from high pressure chamber 65 on the left side of piston 69 proceeds through port 63*a* out exhaust port 61*a*.

When low pressure piston 73 nears the end of its stroke, it will contact enlarged portion 85*a*, pushing valve 55 to the left, as shown in FIG. 6. In the position shown in FIG. 6, high pressure can no longer enter the high pressure chamber on the right side of the piston because inlet port 51*b* will be blocked. The high pressure water flow rather enters through the now opened inlet port 51*a* and port 63*b*. This causes the piston 69 to move to the right pushing piston 73. High pressure fluid on the right side of high pressure piston 69 will be exhausted through port 63*d* out exhaust port 61*b*. As the low pressure piston 73 is pushed to the right it will force fluid out outlet valve 87*d*, as shown in FIG. 6. At the same time intake valve 87*a* will open, allowing surrounding sea water to enter the low pressure chamber 75 on the left side of low pressure piston 73. When low pressure piston 73 nears the end of its stroke to the right, it will contact enlarged portion 85*b*, shifting valve 55 back to the right as shown in FIG. 5, and thereby causing reciprocation.

The output pressure is lowered by a factor proportional to the different cross-sectional areas of the pistons 69 and 73. A suitable size of pressure converter for converting 625 gallons per minute at 2000 psi. to 6,250 gallons per minute at 200 psi. consists of a one foot diameter high pressure piston 69 and a three foot diameter low pressure piston 73, with a five foot stroke. Linear piston speed is kept below two feet per second to give an approximate five second stroke.

GATHERING APPARATUS

Figure 8:
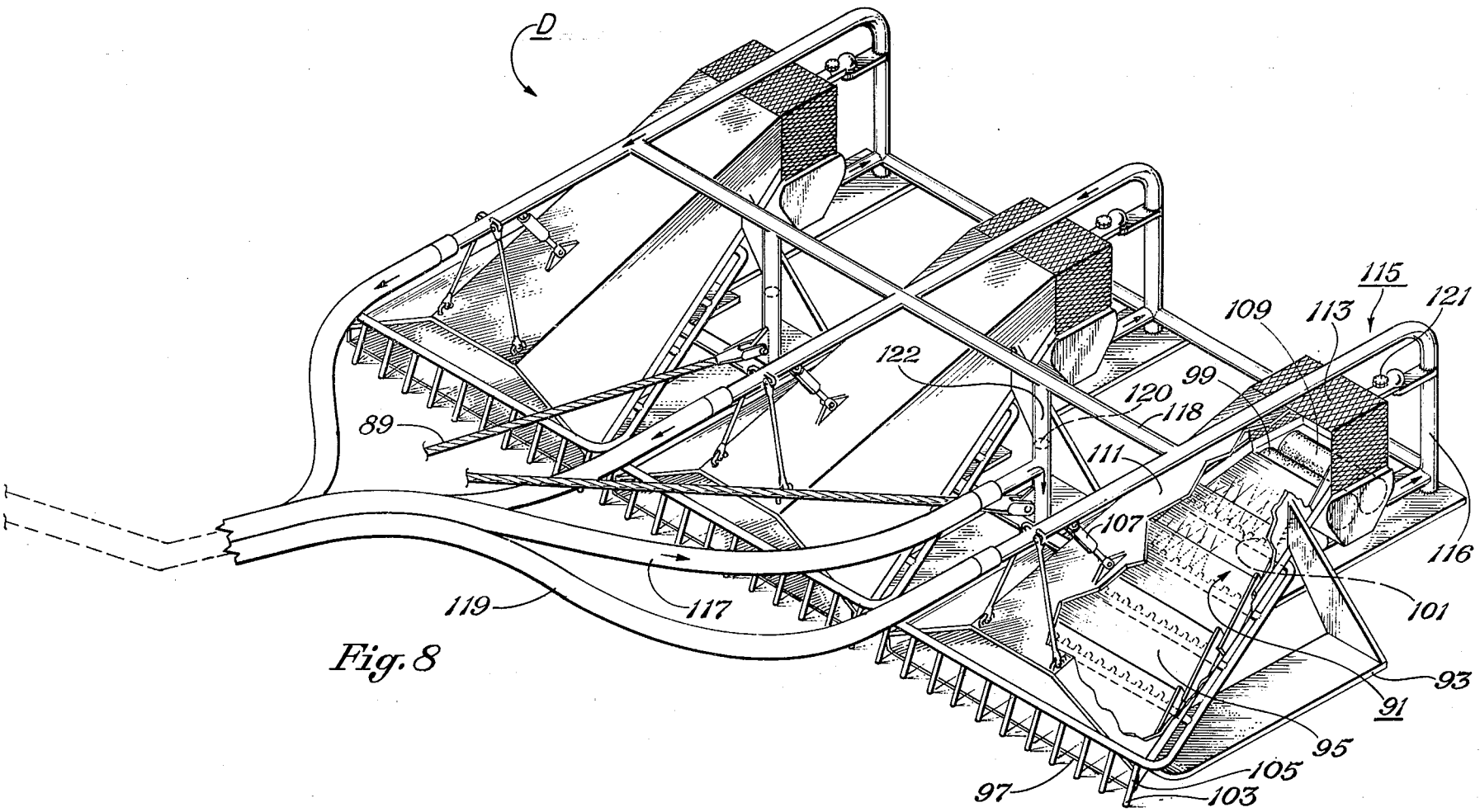
FIG. 8 is perspective view, partially broken away, of a gathering apparatus used in conjunction with the apparatus of FIG. 1.

Referring to FIGS. 8 and 9, the gathering apparatus D, towed on the undersea floor 13 by cable 89, comprises an inclined ramp, chute, or channel 91 carried on a frame or skis 93. Channel 91 is passive and is made up of a plurality of overlapping sheets 95 decreasing in width from the leading edge 97 to the rearward edge 99. A row of flat jet nozzles 101 are mounted at each overlapped intersection to direct water spray up the channel 91. A leading row of flat jet nozzles 103 are mounted in front of the channel 91 on curved pipes 105. Pipes 105 are oriented so that the nozzles 103 are slightly beneath the undersea floor surface, which is normally covered with sediment. The nozzles 103 are directed generally upward and rearward, toward the inclined channel 91. The inclination of channel 91 controls the depth at which the leading edge 97 cuts the surface. Preferably the leading edge 97 is level or slightly lower then the undisturbed undersea floor 13. The inclination is controlled by hydraulic cylinders 107, which are in turn controlled from the surface vessel A.

A pair of cylindrical roller crushers 109 are mounted directly behind rearward edge 99, with the tops of the rollers level or below the edge 99 so that nodules will fall into the rollers to be crushed. The roller crushers 109 are corrugated, rotate in opposite directions to each other, and are spaced apart a selected distance for the desired crushed size. The axes of the rollers are perpendicular to the direction of travel of the gathering apparatus D. The roller crushers 109 are rotated by a water motor, which is actuated by water pressure from pressure converter C.

A cover 111 of sheet metal encloses inclined channel 91 to prevent nodules from escaping. An expanded metal enclosure 113 covers the area above roller crushers 109 to prevent nodules from escaping but allows turbid water to flow through.

In the preferred embodiment, three channels 91 are connected together in parallel. An eduction system 115 comprised of metal conduits extends over and around the channels 91 to provide a frame or support, and to convey water to the nozzles 101, 103, roller crushers 99, and the return flow to bin and feeder mechanism E.

A conduit 116 extends below, around the back and over each crusher 109 and channel 91. These conduits are interconnected by upper and lower transverse conduits 118 to provide a frame for three channels 91. Plugs 120 are located within vertical conduits 122 spaced between the upper and lower transverse conduits 118 to prevent incoming flow from entering the return portion of conduits 116.

Fluid converter C provides a large volume of water at approximately 200 psi. through a flexible hose 117 to the eduction system 115. A portion of the supply water passes beneath roller crushers 99 as indicated by the arrows to educt or draw the crushed nodules along the eduction system 115 to flexible hoses 119 for conveyance to bin and feeder mechanism E.

The hydraulic cylinder 107 for each channel 91 extends between the eduction system 115 and the cover 111. Tow hitches 121, located between the enclosure 113 and eduction system 115 allow lateral and longitudinal flexing.

In operation the surface vessle A tows the gathering apparatus D at a slow rate by the dual pipe B, bin and feeder mechanism E, and cable 89. Water flow, supplied from the surface pumps through the annular passage 29 of the dual string B and through the pressure converter C, is sprayed out nozzles 103 to dislodge nodules 11 as the sled is towed along on its skis 93. Nozzles 101 force the nodules up the inclined channel 91, further dislodging sediment. The nodules are then crushed by roller crushers 109, and further sediment is freed. Portions of this sediment will flow out through enclosure 113. The turbid water and crushed nodules are drawn or educted through conduits 116 and hoses 119 to bin and feeder mechanism E. The turbid water and sediment is diluted by the fresh water being pumped from pressure converter C through hoses 117 to the eduction system 115. The size of the nodules varies but they are normally found within the range from three to six inches in diameter. It is expected to crush them to ½ inch maximum diamter.

BIN AND FEEDER MECHANISM

Referring to FIG. 10, the crushed nodules are educted along conduits 119 to bin 124. The conduits are simply hooked over the open topped bin for discharging the aggregate. Two ball valves 123*a, b* are located below the bottom of bin 124, and provide communication to the feeder mechanism 125. The feeder mechanism 125 comprises two spherical chambers 125*a, b* mounted below bin 124 and ball valves 123*a, b*. Two ball valves 127*a, b* are located below the bottom of the feeder chambers 125 and provide communication to a conduit 129. Ball valves 123 are opposed to each other and opposed to ball valves 127. That is, as shown in FIG. 10, when the top valve 123*b* is open, its corresponding bottom valve 127*b* is closed. Simultaneously top valve 123*a* of feeder chamber 125*a* will be closed and bottom valve 127*a* open. Ball valves 123, 127 are operable by hydraulic actuaters 131, 133, controlled at the surface or by other sensor means.

Conduit 129 extends from below the bottom valves 127 in a loop up to a "T" intersection or distribution chamber 135. Distribution chamber 135 is located below the bottom of bin 124 and at the end of the dual pipe string B. Distribution chamber 135 is in communication with the water supplied from the annular passage 29, and distributes a portion of this water to the pressure converter C and to conduit 129. The downstream end of conduit 129 is in communication with the inner passage 27 of dual string B.

In operation one feeder chamber 125 will be emptying into conduit 129 while the other feeder chamber 125 will be filling. As shown in FIG. 10, feeder chamber 125*a* is emptying into conduit 129, its top valve 123*a* being closed and its bottom valve 127*a* being open. At the same time feeder chamber 125*b* is filling, its top valve 123*b* being open, and its bottom valve 127*b* being closed. The aggregates fall into the conduit 129 at rate of about one feet per second. As the feeder chamber 125*a* is being emptied, clean water pumped from the surface through conduit 129 will fill the chamber since the sphere will be at lower pressure than the fluid in conduit 129. When substantially all of the aggregates have been emptied from feeder chamber 125*a*, valve 127*a* will close and valve 123*a* will open. Aggregates from the bin will then fall into the feeder chamber 125*a*. As they fall, the water in the chamber that they displace will rise up into the bin 124, displacing the turbid water, which flows over the sides of the open topped bin. This eliminates much of the sediment from the water and further cleanses the nodules prior to being transmitted to the surface. As feeder chamber 125*a* is refilling, feeder chamber 125*b* is releasing aggregates into conduit 129. Consequently a continuous stream of aggregates will be provided up the inner passage 27.

The high pressure obtainable by the surface pumps allows a relatively high solids — low volume content of up to 37% crushed nodules by weight. The filling and feeding cycle is expected to take approximately five minutes. In the preferred embodiment, a 20 foot diameter 30 foot high bin 124 is used. Feeder chambers 125*a, b* are 12 feet in diameter, and 12 inch ball valves 123, 127 are used.

It is accordingly seen that an invention having significant improvements has been provided. Use of the dual string provides water power for collecting, crushing, and transmitting aggregate to the surface, without the need for downhole pumps. The pressure converter efficiently converts high pressure, low volume supply to a lower pressure, higher volume supply for use in gathering the nodules. The gathering apparatus and feeder mechanism operate with a minimum of control required from the surface and have few complex parts.

While this invention has been described in only one of its forms it should be apparent to those skilled in the art that it is not so limited but is subject to various changes and modifications without departing from the spirit or scope thereof.

We claim:

1. A method of harvesting mineral aggregates from an undersea floor and conveying them to the surface, comprising:

collecting the aggregates from the undersea floor with a submerged gathering apparatus and crushing them;

conveying the crushed aggregates to a submerged temporary storage bin located near the gathering apparatus;

placing a string of dual concentric pipes from the surface to the bin, the string having inner and outer pipes defining an annular passage and an inner passage selectively for downward flow and upward return flow;

pumping water from the surface down the passage selected for downward flow;

distributing, at the lower end of the string, a portion of the water flow to a conduit that extends under the bin and connects the downward flow passage with the upward return flow passage;

continuously releasing aggregates from the bin into the water flow in the conduit for transmission to the surface within the upward return flow passage;

the step of releasing aggregates into the water flow within the conduit further including;

providing a feeder chamber between the bin and the conduit with a valve at its top in communication with the bin and at its bottom in communication with the conduit;

opening the valve at the top of the feeder chamber to allow a portion of the aggregates to gravity fill the feeder chamber;

closing the valve at the top of the feeder chamber;

opening the valve at the bottom of the feeder chamber to allow aggregates to drop into the water flow in the conduit, causing the feeder chamber to fill with water as the aggregates empty into the conduit;

closing the valve at the bottom of the feeder chamber; and opening the valve at the top of the feeder chamber to gravity fill the feeder chamber with aggregates in order to repeat the procedure, the water within the feeder chamber being displaced by the aggregates falling into the feeder chamber, thereby causing the water to rise within the bin for displacing turbid water.

2. A method of harvesting mineral aggregates from an undersea floor and conveying them to the surface comprising:

moving an inclined channel along the undersea floor;

dislodging the aggregates from the undersea floor by water spray;

forcing the aggregates up the inclined channel by water spray;

mounting a pair of corrugated rotating rollers behind the channel and crushing the aggregates as they fall onto the rollers;

conveying the crushed aggregates to a submerged temporary storage bin;

placing a string of dual concentric pipes from the surface to the bin, the string having inner and outer pipes defining an annular passage and an inner passage;

pumping water from the surface down the annular passage;

distributing at the lower end of the string a portion of the water flow to a conduit that extends under the bin and connects the annular passage with the inner passage;

converting another portion of the flow at the lower end of the string to a substantially lower pressure, higher volume flow for supplying water spray at the inclined channel; and releasing aggregates from the bin into the water flow in the conduit for transmission to the surface in the inner passage.

3. The method according to claim 2 wherein the step of converting a portion of the flow to a lower pressure higher volume further includes:

reciprocably driving a first piston within a high pressure chamber by the water supplied at the lower end of the string;

reciprocating a second piston by the first piston's movement, the second piston being substantially larger in diameter than the first piston and located within a low pressure chamber; and pumping water from the surrounding medium by the second piston to the water spray apparatus at the inclined channel.

4. A method of harvesting mineral aggregates from an undersea floor and conveying them to the surface comprising:

moving an inclined channel along the undersea floor;

dislodging the aggregates from the undersea floor by water spray;

forcing the aggregates up the inclined channel by water spray;

mounting a pair of corrugated rotating rollers behind the channel and crushing the aggregates as they fall onto the rollers;

conveying the crushed aggregates to a submerged temporary storage bin;

placing a string of dual concentric pipes from the surface to the bin, the string having inner and outer pipes defining an annular passage and an inner passage;

pumping water from the surface down the annular passage;

distributing at the lower end of the string a portion of the water flow to a conduit that extends under the bin and connects the annular passage with the inner passage;

converting another portion of the flow at the lower end of the string to a substantially lower pressure, higher volume flow for supplying water spray at the inclined channel; and releasing aggregates from the bin into the water flow in the conduit for transmission to the surface in the inner passage;

the step of moving the inclined channel including connecting tow lines from the inclined channel to the bin, and towing the bin with the surface vessel by the dual pipe string.

5. A gathering apparatus for collecting mineral aggregates from an undersea floor, comprising:

a frame carrying a channel inclined at a selected angle with respect to the undersea floor; the channel comprising a plurality of sheets that are positioned with their edges overlapping and defining a space between them;

a plurality of nozzles to provide water power for dislodging the aggregates and assisting them up the channel, a first portion of the nozzles being located forward of the channel, positioned beneath the undersea floor surface and oriented generally upward and rearward for initially dislodging the aggregates, and a second portion being located below the sheets and oriented generally upward and rearward for spraying through the spaces between the edges to propel the aggregates up the channel; and crusher means for crushing the aggregates into smaller particles and for dislodging accumulated sediment, the crusher means being located at the rearward end of the channel.

6. An apparatus for harvesting mineral aggregates from an undersea floor and transmitting them to a surface vessel, comprising;

a string of dual pipe, the string having inner and outer pipes with an annular passage between the walls of the inner and outer pipes and an inner passage within the inner pipe, defining selectively a downward flow passage and an upward return flow passage;

pump means located on the surface vessel for pumping water down the selected downward flow passage;

gathering means located on the undersea floor for gathering and crushing the aggregates;

a temporary storage bin positioned at the lower end of the dual string and in communication with the gathering means for receiving the crushed aggregates;

a conduit extending under the storage bin, one end in communication with the downward flow passage and the other end in communication with the upward return flow passage; and feeder means for gravity feeding the crushed aggregates from the storage bin into the conduit for transmission to the surface within the upward return flow passage; the feeder means comprising:

two feeder chambers located below the bin and above a portion of the conduit leading to the surface, each having an upper passage in communication with the bin for receiving aggregates and a lower passage in communication with the conduit for allowing aggregates to drop into the conduit; and valve means associated with the upper and lower passages for controlling the transmission of aggregates to the feeder chambers and the conduit; the valve means adapted to cooperate so that while one of the feeder chambers is filling with aggregates, the other feeder chamber is releasing aggregates into the stream of water within the conduit, thereby causing the aggregates to be transmitted continuously to the surface.

7. An apparatus for harvesting mineral aggregates from an undersea floor and transmitting them to a surface vessel, comprising;

a string of dual pipe, the string having inner and outer pipes with an annular passage between the walls of the inner and outer pipes and an inner passage within the inner pipe, defining selectively a downward flow passage and an upward return flow passage;

pump means located on the surface vessel for pumping water down the selected downward flow passage;

gathering means located on the undersea floor for gathering and crushing the aggregates;

a temporary storage bin positioned at the lower end of the dual string and in communication with the gathering means for receiving the crushed aggregates a conduit extending under the storage bin, one end in communication with the downward flow passage and the other end in communication with the upward return flow passage;

feeder means for continuously gravity feeding the crushed aggregates from the storage bin into the conduit for transmission to the surface within the upward return flow passage; and conversion means for converting the downward flow from the surface vessel to a lower pressure, higher volume supply for gathering functions comprising:

dual coacting pistons located in separate chambers and connected by a common shaft, one piston and chamber being in communication with the downward flow, the other piston and chamber being substantially larger in diameter and having an intake in communication with the surrounding sea and an outlet in communication with the gathering means; and valve means acting in cooperation with the pistons for causing reciprocation of the pistons, so that the smaller piston will drive the larger piston, causing it to pump water from the surrounding sea to the gathering apparatus.

8. A method of providing water to a submerged gathering apparatus for collecting mineral aggregates from an undersea floor and for transmitting the aggregates to the surface comprising;

placing a string of dual concentric pipes from the surface to a submerged temporary storage bin, the string having inner and outer pipes defining an annular passage and inner passage selectively for downward flow and upward return flow;

pumping water from the surface down the passage selected for downward flow;

distributing, at the lower end of the string, a portion of the flow to the gathering apparatus;

distributing another portion of the flow to a conduit that provides a loop that extends beneath the bin between the downward flow passage and upward return flow passage; and continuously gravity feeding aggregates from the bin into the conduit so as to be carried by the upward return flow to the surface.

9. A method of providing water to a submerged gathering apparatus for collecting mineral aggregates from an undersea floor, and for transmitting the aggregates to the surface comprising:

placing a string of dual concentric pipes from the surface to a submerged temporary storage bin, the string having inner and outer pipes defining an annular passage and inner passage selectively for downward flow and upward return flow;

pumping water from the surface down the passage selected for downward flow;

converting a portion of the downward flow at the end of the string to a substantially lower pressure and higher volume for the gathering apparatus;

distributing a portion of the downward flow to a conduit that provides a loop that extends beneath the bin between the downward flow passage and upward return flow passage; and gravity feeding aggregates from the bin into the conduit so as to be carried by the upward return flow to the surface.

10. The method according to claim 9 wherein the step of converting a portion of the downward flow further includes:

reciprocally driving a first piston within a high pressure chamber in communication with the downward flow;

reciprocating a second piston by the first piston movement, the second piston being larger in diameter than the first piston and located within an adjacent low pressure chamber; and pumping water by movement of the reciprocating second piston from the surrounding medium to the gathering apparatus.

11. A method of providing water to a submerged harvesting means of the type for collecting mineral aggregates from an undersea floor, and for transmitting the aggregates to the surface, comprising:

placing a string of dual concentric pipes from the surface to the harvesting means, the dual string having inner and outer pipes defining an annular passage and an inner passage selectively for downward flow and upward return flow;

pumping water from the surface down the passage selected for downward flow;

converting, at the lower end of the dual string a portion of the flow to a lower pressure, higher volume for use in collecting the mineral aggregates;

returning a portion of the flow up the return flow passage; and placing aggregates collected from the harvesting means into the return flow passage for transmission to the surface.

12. An apparatus for supplying a flow of water to submerged harvesting apparatus having gathering means for collecting mineral aggregates from an undersea floor and feeder means for transmitting the aggregates to the surface, comprising:

a string of dual pipes extending down from a surface vessel to the harvesting apparatus and having concentric inner and outer pipes with an annular passage between the walls of the inner pipe and the outer pipe, and an inner passage within the inner pipe, defining selectively a downward flow passage and an upward return flow passage;

pump means located on the surface vessel for pumping water down the annular passage;

a distribution chamber located at the end of the dual string in communication with the downward flow passage;

conversion means in communication with the distribution chamber and the gathering apparatus for converting the downward flow from the annular passage to a substantially lower pressure higher volume supply for the gathering means; and a conduit extending from the distribution chamber to the feeder means and thence to the upward return flow passage of the dual stream for transmitting the aggregates to the surface.

13. The apparatus according to claim 12 wherein the conversion means comprises:

dual coacting pistons located in separate chambers and connected by a common shaft, one chamber being in communication with the higher pressure lower volume supply from the annular passage, the other piston and chamber being substantially larger in diameter and in communication with the gathering apparatus, and having an intake in communication with the surrounding sea; and sliding valve means reciprocated by the pistons to open and close ports for causing reciprocation of the pistons, so that the smaller piston will drive the larger piston, causing it to pump water taken from the surrounding sea to the gathering apparatus.

14. The apparatus according to claim 12 wherein the inner and outer pipes in the string of dual pipes comprise a plurality of stands, the outer pipes being connected together by threaded joints, and the inner pipes telescoping at their ends within each other, and wherein the annular passage is selected for downward flow.

15. The apparatus according to claim 14 further comprising seal means at the threaded joints of the outer pipes for preventing water from the annular passage from entering the threads.

* * * * *